US006662844B2

(12) United States Patent
Huang

(10) Patent No.: US 6,662,844 B2
(45) Date of Patent: Dec. 16, 2003

(54) ADHESIVE TAPE DISPENSER WITH ANTI-REVERSE ROLL ROTATION CAPABILITY

(76) Inventor: Harrison Huang, No. 23, Lin T'So Rd., Sheng Kang Hsian, Taichung Hsien (TW)

( * ) Notice: Subject to any disclaimer, the term of this patent is extended or adjusted under 35 U.S.C. 154(b) by 54 days.

(21) Appl. No.: 10/116,136

(22) Filed: Apr. 5, 2002

(65) Prior Publication Data

US 2003/0116598 A1 Jun. 26, 2003

(30) Foreign Application Priority Data

Dec. 25, 2001 (TW) ..... 90222786 U

(51) Int. Cl.[7] ..... B32B 31/00

(52) U.S. Cl. ..... 156/527; 156/523; 156/574; 156/577; 156/579; 225/20; 225/56; 225/77; 225/82; 225/84

(58) Field of Search ..... 156/523, 527, 156/574, 576, 577, 579; 225/19, 20, 56, 82, 84, 77, 90

(56) References Cited

U.S. PATENT DOCUMENTS 5,381,942 A * 1/1995 Lin ..... 225/56

5,573,616 A * 11/1996 De Roeck ..... 156/185

* cited by examiner

*Primary Examiner*—Richard Crispino
*Assistant Examiner*—Cheryl N. Hawkins
(74) *Attorney, Agent, or Firm*—Browdy and Neimark, P.L.L.C.

(57) ABSTRACT

An adhesive tape dispenser is comprised of a dispensing body that provides for the loading of a roll of tape at its rear portion and a blade mounted on the dispensing body. A roller, a guide wheel, and a pawl are respectively pivotally mounted in the dispensing body. The roller has a plurality of protrusions arranged around one end thereof. The pawl has a pressing member capable of positioning against the circumferential face of the roller as well as an engaging portion capable of becoming engaged between two protrusions of the roller, and the pawl is postured to the rear by an elastic member. Tape is inserted between the roller and the pawl and then routed pass the guide wheel to the area of the blade and when it is applied forward, the roller correspondingly rotates forward in the same direction and the protrusions allow the engaging portion to slide over them. Since the rear side of the pawl is engages the protrusions, counter rotation by the roller is not possible and tape is not retracted in the opposite direction.

9 Claims, 4 Drawing Sheets

ADHESIVE TAPE DISPENSER WITH ANTI-REVERSE ROLL ROTATION CAPABILITY

FIELD OF THE INVENTION

The present invention relates generally to tape dispensing devices, specifically to an adhesive tape dispenser with anti-reverse roll rotation capability.

BACKGROUND OF THE INVENTION

Post offices, the delivery industry, and factory shipping departments utilize large width adhesive tape to seal packages (the widest type is used to tape carton bottoms). Due to the intensity of such operations, handheld adhesive tape dispensers are typically utilized for such sealing to simplify and quicken the drawing out of tape applied onto packages.

However, conventional adhesive tape dispensers are often troublesome to utilize. Since the roll of tape in the dispenser rotates freely, if the rotational direction of the adhesive tape roll is reversed due to angular disposition or an unanticipated application of external force, the small portion at end of the tape spindles back and sticks onto the circumferential surface of the adhesive tape roll. As such, it is necessary to undertake the arduous ordeal of once again finding the end of the adhesive tape during usage.

SUMMARY OF THE INVENTION

The primary objective of the present invention is to provide an adhesive tape dispenser with anti-reverse roll rotation capability that effectively prevents the end of the adhesive tape from spindling back and clinging to the circumferential surface of the adhesive tape roll to thereby increase convenience during utilization.

To achieve the objective, the adhesive tape dispenser provided by the present invention is comprised of a dispensing body having a pivot for pivotally mounting a roll of tape thereon and a stop portion, a roller, a pawl, an elastic member, a guide wheel and a blade. The roller is pivotally mounted in the dispensing body and has a plurality of protrusions arranged around the axis thereof at one end. The pawl is pivotally hinged in the dispensing body and has a pressing member which has an edge against the periphery of the roller, and an engaging portion at one end thereof which is capable of engaging in between two said protrusions. The pawl is stopped at said stop portion of the dispensing body when the pawl is pivoted backwards, thereby preventing the roller being rotated backwards. The elastic member is mounted in the dispensing body and adapted to force said pawl to be pivoted backwards. The guide wheel is pivotally mounted in the dispensing body and disposed in front of the roller. The blade is mounted on the front end of the dispensing body. The tape is inserted between the periphery of the roller and the pressing member of the pawl and then routed over the periphery of the guide wheel to the blade. The roller is rotated forwards when the roll of tape is rotated forwards during application such that the engaging portion of said pawl is pushed forwards by the protrusions of the roller and then engages in between the next two said protrusions.

DETAILED DESCRIPTION OF THE INVENTION

Figure 1:
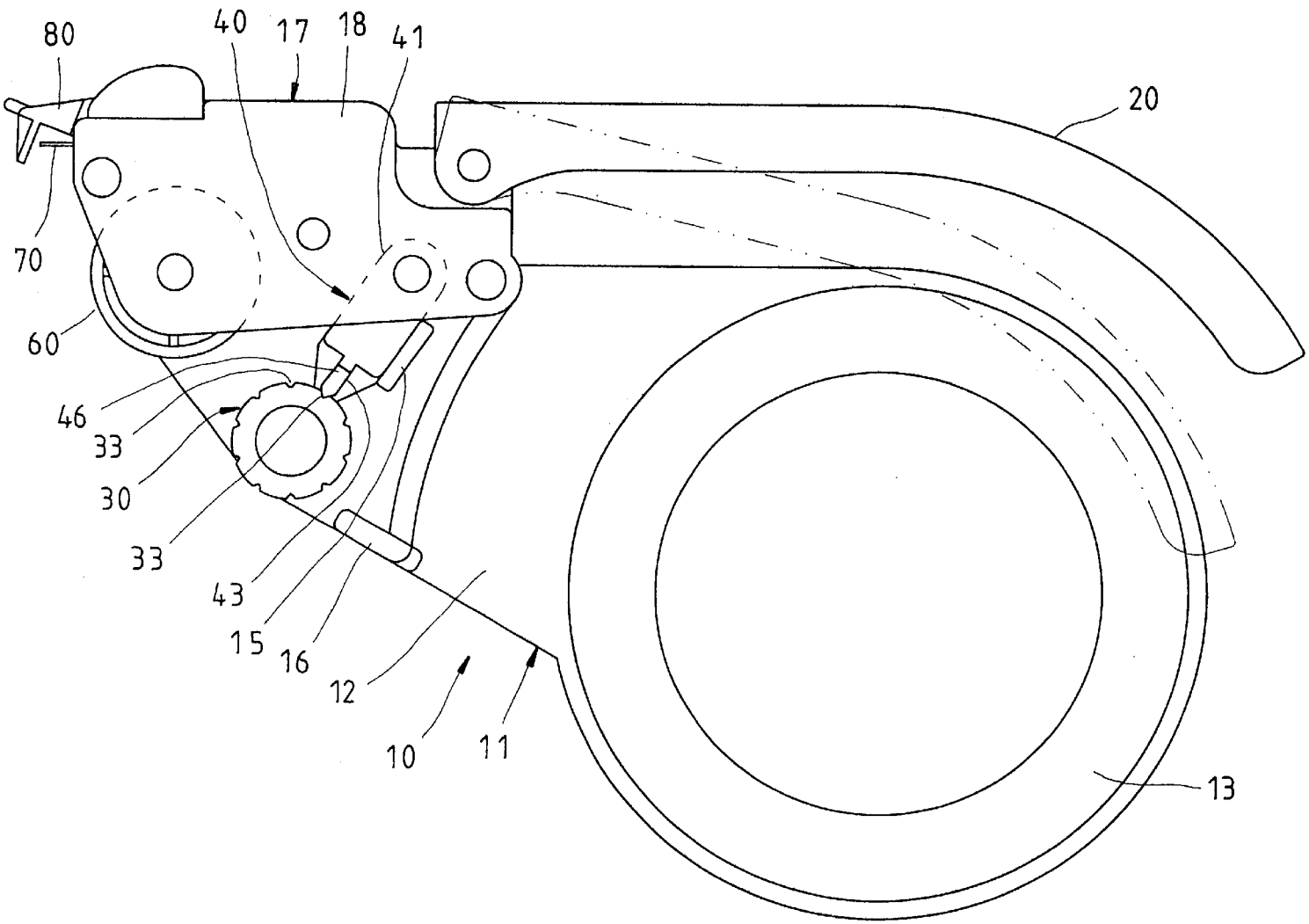
FIG. 1 is a side view of a preferred embodiment of the present invention.

Referring to all the drawings, the adhesive tape dispenser of a preferred embodiment of the present invention is comprised of a dispensing body 10, a tape cover 20, a roller 30, a pawl 40, an elastic member 50, a guide wheel 60, a blade 70 and a blade cover 80.

Figure 2:
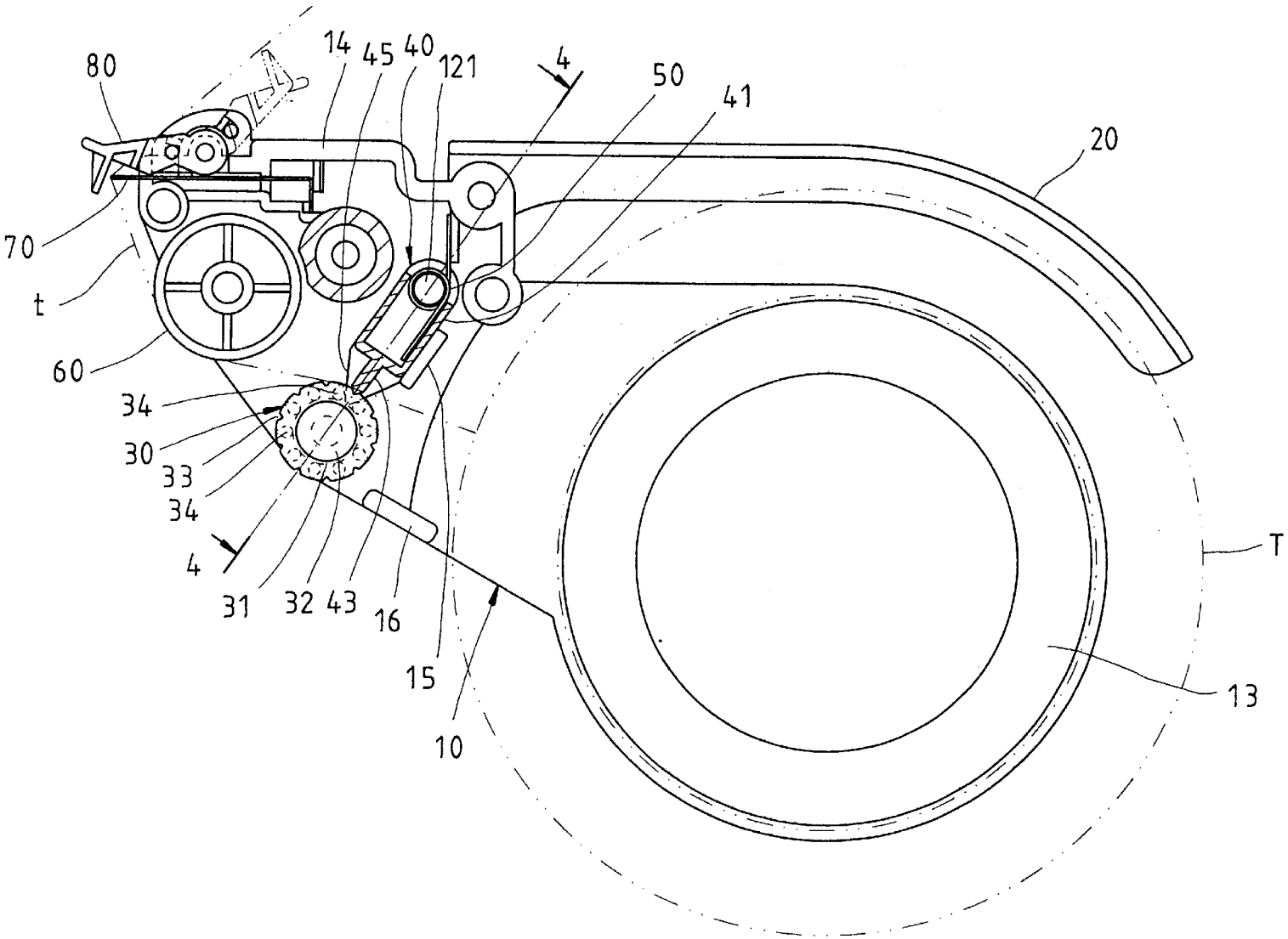
FIG. 2 is a sectional view of the preferred embodiment of the present invention, showing a roll of adhesive tape is loaded and ready for dispensing.
Figure 3:
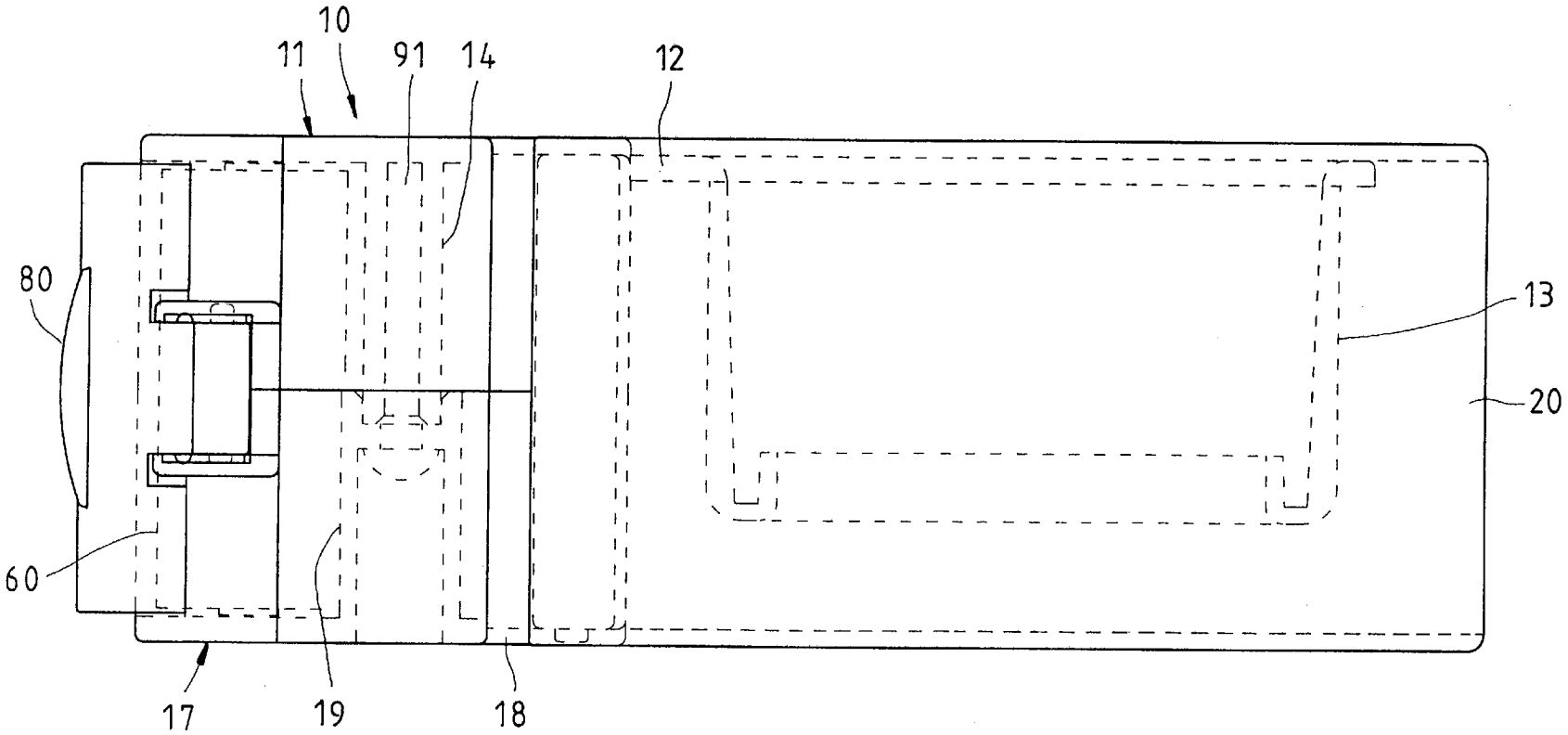
FIG. 3 is a top view of the preferred embodiment of the present invention.

The dispensing body 10, as indicated in FIGS. 1–3, comprises a main member 11 and a secondary member 17 that are assembled together. The main member 11 has a main portion 12, a hollow, tubular pivot 13 projecting perpendicularly from the rear lateral end of the main portion 12 that is utilized for mounting a roll of tape T (as shown in FIG. 2), a plurality of post- or curved planar fastening portions 14 projecting along the front lateral end of the main portion 12, a platelike stop portion 15 protruding from the center area of the main portion, and a tape rest portion 16 extending from the bottom edge of the main portion. The secondary member 17 has a main portion 18 and a plurality of corresponding fastening portions 19 projecting from one side of the main portion 18. The main portion 18 of the secondary member 17 is disposed parallel to the main portion 12 of the main member 11 and, furthermore, its fastening portions 19 are firmly fastened to the corresponding fastening portions 14 of the main member 11 by means of screws 91 so as to form the dispensing body 10.

The tape cover 20 is a rectangular plate having one end slightly curved, and the other end of which is pivotally conjoined to the top side of the dispensing body 10 such that the curved end of the tape cover 20 covers the upper extent of the roll of tape T and is capable of being turned upward.

Figure 4:
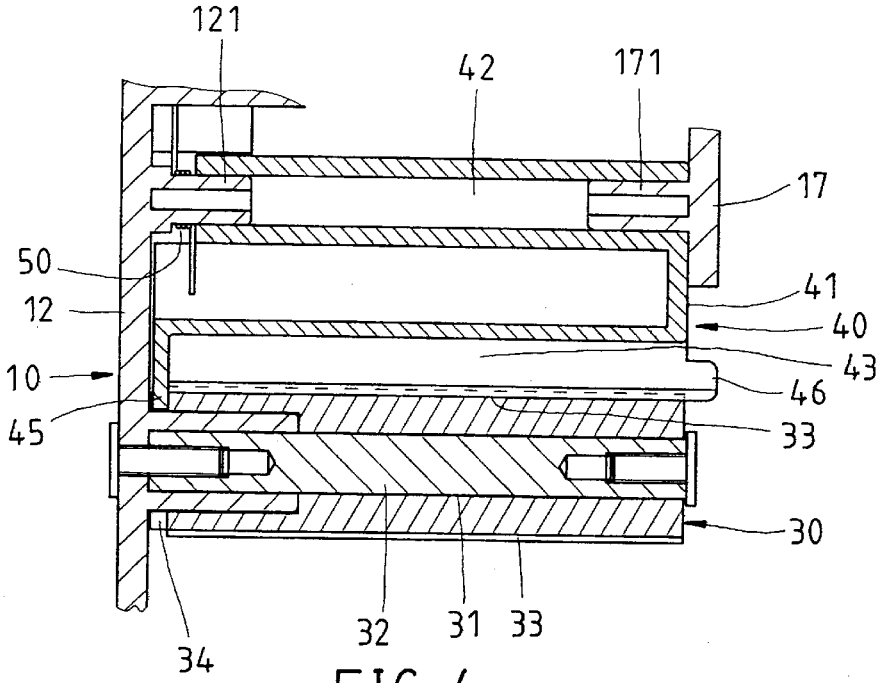
FIG. 4 is a sectional view taken along line 4—4 in FIG. 2.
Figure 5:
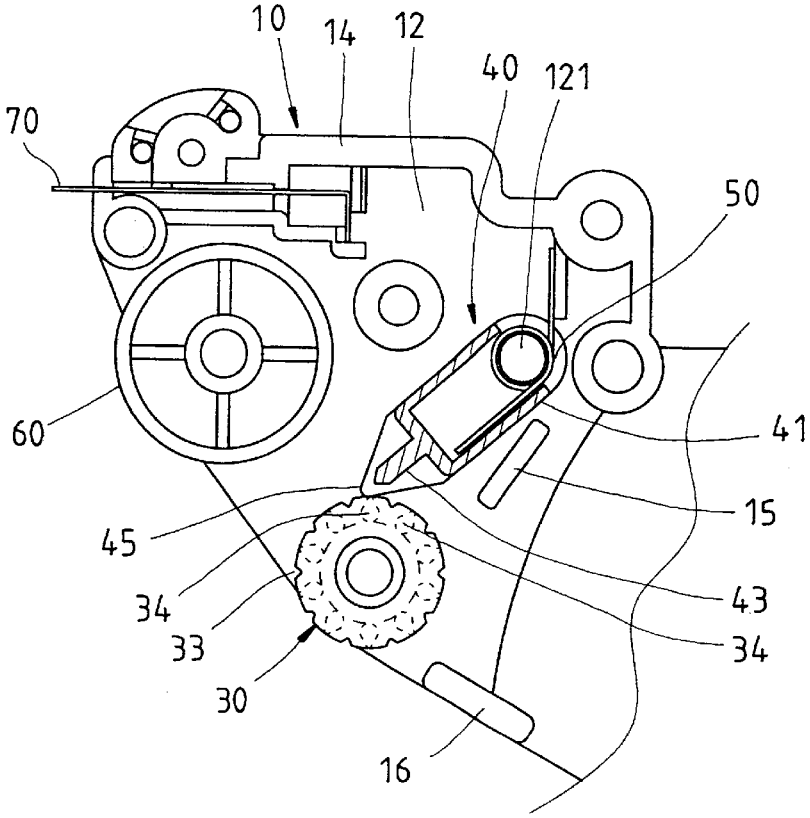
FIG. 5 is an enlarge view of a portion of the preferred embodiment of the present invention.

Please refer to FIGS. 4–5, the roller 30 is cylindrical in shape and has a pivot hole 31 through its axial center, a shaft 32 is inserted through the pivot hole 31 and its inner extremity is perpendicularly embedded into the main portion 12 of the main member 11 of the dispensing body 10 (as shown in FIG. 4) such that the roller 30 is capable of rotating in place adjacent to the front end of the dispensing body 10 and its outer end is visible at the lower extent of the main portion 18 of the secondary member 17. The roller 30 has a plurality of grooves 33 extend in an axially oriented, even distribution along the circumferential face of the roller 30 and the sectional profile of each groove 33 is triangular. In addition, a plurality of protrusions 34 are formed at equal angles apart in the end edge around the axis of the roller 30, the quantity of which is equal to that of the grooves 33. As viewed from the end face of the roller (as shown in FIG. 2 and FIG. 5), the protrusions 34 and the grooves 33 are arranged in alternation. Furthermore, the outer sides of the protrusions 34 farther from its axial center are gradually diminished in shape.

The pawl 40 having a shaft 41, a pivot hole 41 through the shaft 41, and a pressing member 43 extending from the outer portion of the shaft 41, with the portion at the outer edge of the pressing member 43 being of a pointed profile. The pawl 40, by means of the pivot hole 42 entrances at its two ends, is respectively sleeved onto posts 121 and 181 (as shown in FIG. 4) at the interior surface of the main portion 12 of the main member 11 and the main portion 18 of the secondary member 17 and is capable of revolving towards the upper extent of the roller 30 adjacent to the front end of the dispensing body 10. The pressing member 43 is postured vertically downward and, furthermore, its bottom edge against the circumferential face of the roller 30. In addition, the pawl 40 has a triangle-shaped engaging portion 45 extending downward from its inner end and. Based on the inclination angle of the pawl 40, the engaging portion 45 engages a bottom lands between two protrusions 34 (as shown in FIG. 2) of the roller 30 or is disengaged from the outer sides of the protrusions 34 (as shown in FIG. 5). When the pawl 40 is inclined to the rear, it is immobilized by the stop portion 15 of the dispensing body 10 at the position indicated in FIG. 2, at which time the bottom edge of the pressing member 43 enters one of the grooves 33 along the circumferential face of the roller 30 and the engaging portion 45 is correspondingly engaged between two protrusions 34. In addition, the pressing member 43 has a trip element 46 (as shown in FIG. 4) extending outward from its exterior edge that is visible at the lower extent of the secondary member 17 of the dispensing body 10.

An elastic member 50, which is a torsion spring in this embodiment, is installed at the interior end of the pawl 40 such that its coils are situated around the post 121 of the dispensing body 10 (as shown in FIG. 4) which the pawl 40 is sleeved onto and, furthermore, one of its extremities is postured against the dispensing body 10 and the other extremity is situated against the pawl 40, with its decompressive force impelling the pawl 40 into a rearward inclination.

A guide wheel 60 of a cylindrical shape is pivotally mounted between the main portion 12 of the main member 11 and the main portion 18 of the secondary member 17 of the dispensing body 10 and situated in front of the roller 30 and the pawl 40.

A blade 70 is mounted on the front end of the dispensing body 10 that has a serrated anterior edge and, furthermore, is positioned parallel to the axis of the guide wheel 60.

A blade cover 80 is hinged onto the front end of the dispensing body 10 and situated over the upper extent of the blade 70 that is capable of being folded down and fixed into position, as indicated in FIG. 2, to conceal the cutting edge of the blade 70 as a protective function and capable of being folded up into a fixed position, as indicated in FIG. 2, to expose the blade 70.

Given the structure of the adhesive tape dispenser provided by the preferred embodiment of the present invention, the tape cover 20 is first opened before utilization and a roll of tape T is sleeved onto the tubular pivot 13 of the dispensing body 10 carrier portion 13 (after which the tape cover 20 is closed) and, furthermore, tape t is then pulled from the roll of tape T. Thereafter, the trip element 46 of the pawl 40 is actuated, causing the pressing member 43 of the pawl 40 to incline forward such that sufficient clearance is present between its bottom edge and the circumferential face of the roller 30, following which the tape t is inserted between the pressing member 43 and the roller 30 (Note: Attention must be paid to the winding direction of the roll of tape T such that the adhesive surface of the tape t is at this time facing towards the circumferential face of the roller 30.) and after the tape t has been correctly inserted, the pawl 40 is released, subjecting the pawl 40 to the rebound force of the elastic member 50 such that the bottom edge of the pressing member 43 lightly presses the tape t against the circumferential face of the roller 30. Thereafter, the tape t is then pulled out to an adequate length with its surface passing over the circumferential face of the guide wheel 60 up to (or beyond) the anterior edge of the blade 70.

When utilizing the adhesive tape dispenser, four fingers are placed within the interior portion of the tubular pivot 13 of the dispensing body 10 and the thumb is positioned against the tape cover 20 such that the dispensing body 10 is held in one hand. During adhesive tape application, the blade cover 80 is folded open to enable the attachment of the tape t onto an object and then the entire tape dispenser is drawn to the rear such that the roll of tape T remains stationary but rotates continuously at its original position (counter-clockwise rotation is depicted in FIG. 2) as the tape t is dispensed. Following the application of an appropriate length, the front end of the tape dispenser is pressed downward and towards the rear to cut the tape t with the blade 70.

During the process of adhesive tape application, the roller 30 rotates forward (rotation is counter-clockwise in FIG. 2 and is hereafter referred to as rotation in the same direction) due to the adhesive stick of the tape t and when the roller 30 rotates in the same direction, the protrusions 34 undulate the engaging portion 45 of the pawl 40, with the relative angle shown in FIG. 2, and the engaging portion 45 is pushed forward by the outer sides of the protrusions 34, but when the roller 30 then proceeds forward in the same direction of rotation and after a minute angular disposition, since the pawl 40 is pushed backward by the elastic member 50, the engaging portion 45 then engages in between the next two protrusions 34 and reverts to the relative relationship indicated in FIG. 2 and, as such, the pawl 40 is repeatedly rocked back and forth (Note: The outer sides of the protrusions 34 and end of the engaging portion 45 are of a pointed profile to aid the sliding in and out of the engaging portion 45.). When the roller 30 is rotated in the same direction, the pawl 40 is accordingly brought forward and disengaged such that the forward delivery of tape t is not affected and the bottom edge of its pressing member 43 presses the tape t evenly against the circumferential face of the roller 30, thereby maintaining the smooth dispensing of the tape t.

After the tape t has been cut (specifically, during disuse), a small portion of adhesive tape remains affixed to the circumferential face of the roller 30, with its unwound rear extent held fast against the tape rest portion 16 of the dispensing body 10 such that the tape t does not attach itself to other objects.

As previously described, when the pawl 40 is inclined to the rear, it is immobilized by the stop portion 15 and engaged to the roller 30, with the relative angle shown in FIG. 2. As such, the exerted force causes the backward rotation in the opposite direction of the roller 30 and, due to the relative angle, the protrusions 34 of the roller 30 are engaged by the engaging portion 45 of the pawl 40 and, therefore, the roller 30 is immediately arrested and cannot rotate in the opposite direction. In other words, if the roll of tape T is rotated backwards in the opposite direction due to an unintentional application of external force while the tape dispenser of the present invention being utilized, since the front end of the tape t is affixed onto the roller 30 which is disabled from rotating in the opposite direction in this state (and is also restrained by the pressing member 43), rotating the roll of tape T in the reverse direction is difficult and, as a result, the tape t cannot retract and cling to itself.

As conveyed by the description, the adhesive tape dispenser provided by the present invention effectively prevents the troublesome occurrence of adhesive tape retraction and sticking, thereby enabling ease and convenience during tape application.

What is claimed is:

1. An adhesive tape dispenser comprising:

a dispensing body having a front portion, a rear portion, a pivot adjacent to the rear portion for pivotally mounting a roll of tape thereon, and a stop portion adjacent to the front portion;

a roller pivotally mounted in the front portion of the dispensing body with the axis thereof parallel to that of the roll of tape, said roller having a plurality of protrusions arranged around the axis thereof at one end;

a pawl pivotally hinged in the front portion of the dispensing body and having a pressing member which has an edge against the periphery of the roller, and an engaging portion at one end thereof which is capable of engaging in between two said protrusions; said pawl being stopped at said stop portion of the dispensing body when the pawl is pivoted towards the rear portion of the dispensing body, thereby preventing the roller being rotated backwards;

an elastic member mounted in the dispensing body and adapted to force said pawl to be pivoted towards the rear portion of the dispensing body;

a guide wheel pivotally mounted in the front portion of the dispensing body and disposed in front of the roller with the axis thereof parallel to that of the roller;

a blade mounted on the front end of the dispensing body;

wherein the tape is inserted between the periphery of the roller and the pressing member of the pawl and then routed over the periphery of the guide wheel to the blade;

wherein said roller is rotated forwards when the roll of tape is rotated forwards during application such that the engaging portion of said pawl is pushed forwards by the protrusions of the roller and then engages in between the next two said protrusions.

2. The adhesive tape dispenser as defined in claim 1, wherein said elastic member is a torsion spring having two extremities; wherein one extremity of the torsion spring is postured against the dispensing body and the other extremity is situated against the pawl, thereby forcing the pawl to be pivoted towards the rear portion of the dispensing body.

3. The adhesive tape dispenser as defined in claim 1, wherein the outer sides of the protrusions of the roller farther from the axis of the roller are gradually diminished in shape and the engaging portion of the pawl is of a triangle shape.

4. The adhesive tape dispenser as defined in claim 1, wherein the roller has a plurality of grooves extending in an axial orientation along its circumferential face and the pressing member of the pawl is capable of engaging with one of the grooves.

5. The adhesive tape dispenser as defined in claim 4, wherein said pressing member of the pawl is engaged with one of the grooves of the roller and the engaging portion of the pawl is engaged between two said protrusions of the roller when the pawl is stopped at the stop portion of the dispensing body.

6. The adhesive tape dispenser as defined in claim 1, wherein said pawl has a trip element disposed at the lateral side of the pressing member and exposed outside.

7. The adhesive tape dispenser as defined in claim 1, wherein said dispensing body has a tape rest portion disposed in rear of the roller.

8. The adhesive tape dispenser as defined in claim 1, wherein the pivot of said dispensing body is of a hollow, tubular construction; wherein said tape dispenser further comprises a tape cover pivotally mounted at one end thereof on the top side of the dispensing body and covering the roll of tape and capable of being pivoted upwardly.

9. The adhesive tape dispenser as defined in claim 1 further comprising a blade cover hinged over the blade.

* * * * *